United States Patent [19]

de Christopher

[11] 4,431,106

[45] Feb. 14, 1984

[54] PACKAGE

[76] Inventor: Eugene L. de Christopher, 25 Beach Rd., Apt. L, Belvedere, Calif. 94920

[21] Appl. No.: 352,359

[22] Filed: Feb. 25, 1982

[51] Int. Cl.[3] ..... B65D 85/36

[52] U.S. Cl. ..... 206/525; 206/303; 206/45.11; 229/8; 229/41 C

[58] Field of Search ..... 206/303, 525, 527, 499, 206/45.11, 545, 551, 45.32; 229/41 C, 8, 16, 6

[56] References Cited

U.S. PATENT DOCUMENTS

| | | | |
|---|---|---|---|
| 773,814 | 11/1904 | Shotts | 229/41 C |
| 1,857,231 | 5/1932 | Allen | 206/45.11 |
| 2,955,738 | 10/1960 | Bacchus et al. | 229/41 C |
| 3,446,419 | 5/1969 | Mueller | 206/303 |
| 3,668,796 | 6/1972 | Patterson | 229/8 |

*Primary Examiner*—William T. Dixson, Jr.

[57] ABSTRACT

A package especially adapted for frangible articles is formed from a unitary blank of sheet material such as paper board, metal, or plastic. The sheet material is scored and bent to provide a plurality of sections extending radially outwardly from a prismatic central opening.

11 Claims, 8 Drawing Figures

Fig. 1.
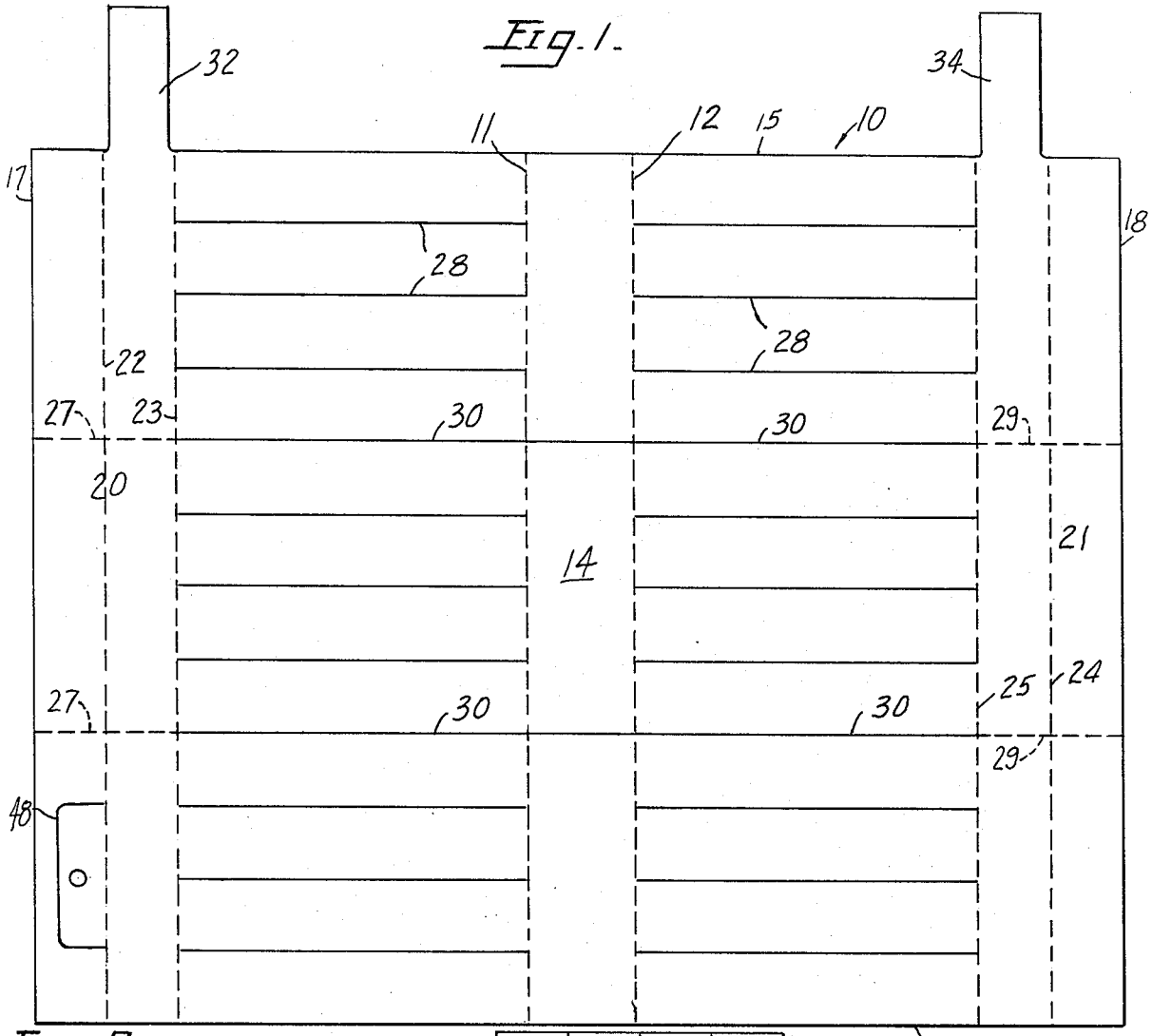
Fig 2
Fig. 3.
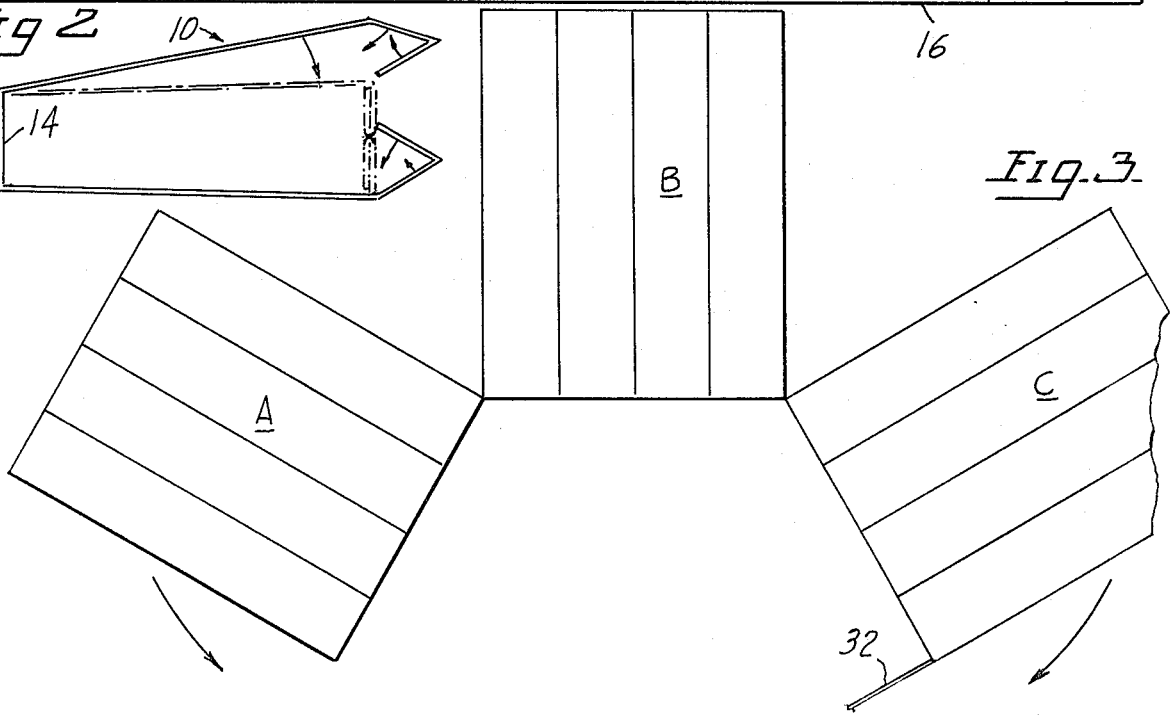

Fig 4
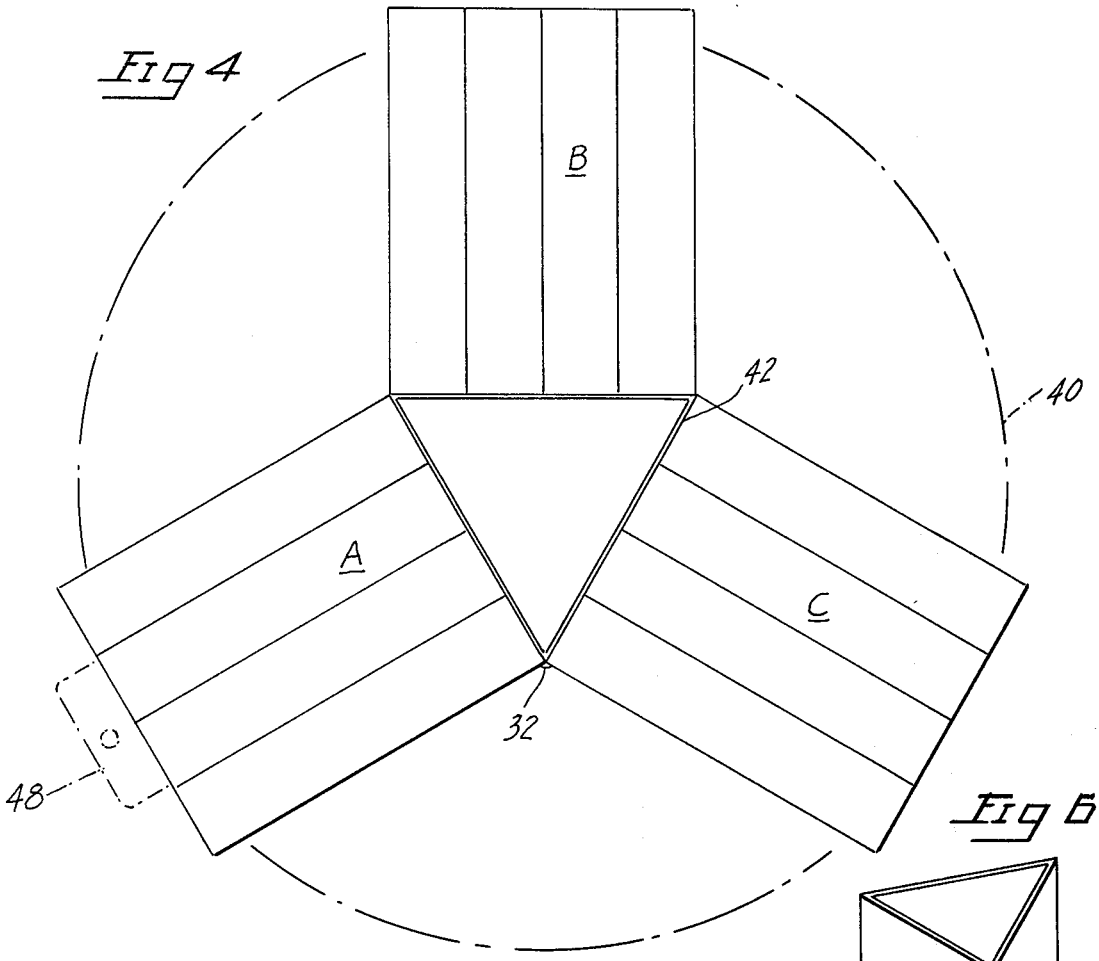
Fig 6
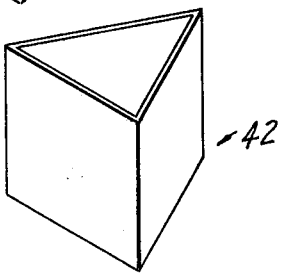
Fig 5
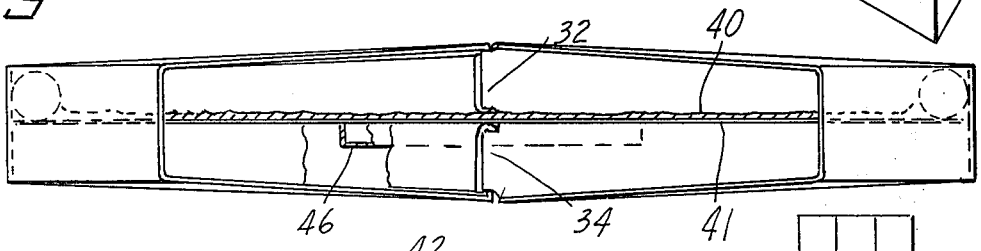
Fig 7
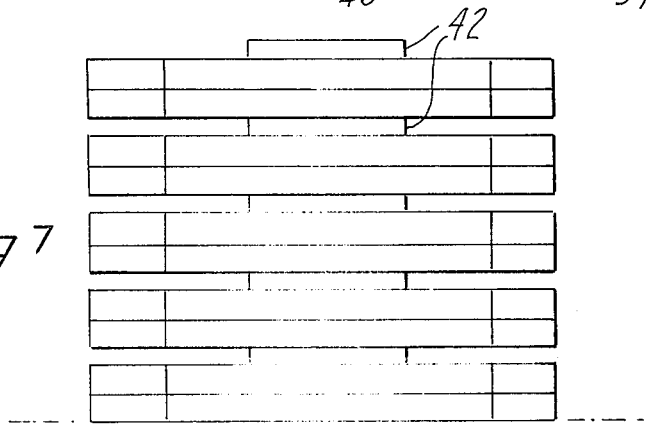
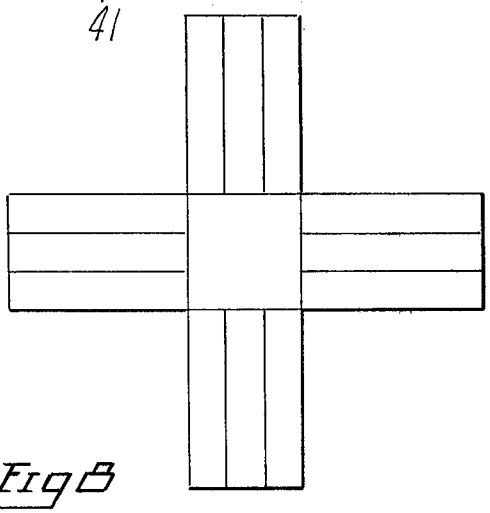
Fig 8

PACKAGE

This invention relates to a package especially adapted to contain delicate frangible articles such as pastries, pizzas and similar baked products.

The main object of the invention is to provide a novel package for frangible articles and which package is inexpensive and affords optimum protection for its contents.

Another object is the provision of a package that is especially adapted to contain pizza shells and other similar articles.

Still another object is the provision of a pizza shell package which affords the pizza the desirable amount of ventilation for cooling after baking.

Yet another object is to provide a package which is formed so as to permit stacking a plurality of filled packages.

Other objects and advantages will be apparent from the following specification and drawings:

FIG. 1 is a plan view of the blank from which the package is formed.

FIG. 2 is an end elevation of the blank showing the same partially folded during formation of the package.

FIG. 3 is a top plan view partially broken away to accommodate the sheet showing a second intermediate step in forming the package.

FIG. 4 is a top plan view of the completed package.

FIG. 5 is a side elevation of the package of FIG. 4 showing a pizza therein partially in section with a portion of the package broken away to show internal structure.

FIG. 6 is an isometric view of the spacer.

FIG. 7 is a reduced scale view of a stack of packages.

FIG. 8 is a reduced scale top plan view of another form of the package.

In detail, and first with reference to FIG. 1, the preferred form of the invention is formed from a unitary blank 10 of sheet material such as paper board, metal, or plastic. Said blank 10 is substantially rectangular and is formed with a pair of score lines 11,12 defining an elongated central section 14 extending from one end edge 15 to the opposite end edge 16.

Adjacent the opposite side edges 17,18 are elongated marginal portions 20,21. These marginal portions are each provided with a pair of score lines indicated at 22,23 on portion 20 and 24,25 on opposite portion 21. These score lines are parallel to each other and to the adjacent side edge of the blank.

Extending between said opposite marginal portions 20,21 and central portion 14 are cut lines 28 and extending between the opposite edges marginal portions 20,21 are two cut lines 30 which divide the blank 10 into six sections extending outwardly from said central portion. In continuation of cut lines 30 and in marginal portions 20,21 are score lines 27,29.

As will be noted later on, the cut lines 28 may vary from the number shown since they affect only the amount of air circulation desired. Similarly it will be seen that there may be more than two cut lines 30 depending on the particular final shape of package desired.

Along the upper side edge 15 of blank 10 and projecting outwardly therefrom are integral tongues 32,34 for a purpose to be described.

In FIG. 2 there is shown the first step in forming the package. The sides of the blank 10 on opposite sides of central section 14 are folded toward each other along score lines 11,12 and, as indicated by arrows, the marginal portions 20,21 are folded on themselves along score lines 22,23 and 24,25 to provide reinforcing flanges indicated by dot-dash lines in their final position in FIG. 2.

At this point it will be noted that three sections A,B,C (FIG. 3) are formed by the folded blank 10 and each section includes a top, a bottom, an outer side wall formed by central section 14 and a two piece inner side wall formed by the folded marginal portions 20,21.

These three sections are then swung as indicated in FIG. 3 about hinge lines 27,29 in marginal portions 20,21 to the final position shown in FIG. 4.

The two parts of the folded over margins 20,21 may be adhesively secured together during the above steps but preferably, after the article to be packaged is inserted, the free ends of the tops and bottoms of sections A and C are first connected together by inserting tongues 32,34 between the folded over portions of the margins as seen in FIG. 5.

In FIG. 5 a pizza 40, supported on a thin tray or disk 41, is shown in the package. It will be seen that the relatively thin central portion of the pizza shell and its tray are interposed between the folded over margins which define the inner sidewalls of the three sections A,B,C.

The tray 41 may be made of paper board or plastic and rests on the triangular shaped support defined by the lower folded over margin 21. As best seen in FIG. 5 the disk forming the tray 41 may be formed with a downwardly projecting prismatic portion or well 46 which is adapted to fit within the central space formed by the package. By this structure the tray 41 is held against shifting relative to the package. It will also be noted in this connection that the pizza shown in the drawings is itself prevented from shifting by the outer peripheral sidewalls of the package.

In FIG. 6 there is shown a spacer generally designated 42 which may be formed from paper board or plastic to a triangular prism shape and adapted to be received within the central opening formed by the upper marginal portions 20.

As best seen in FIG. 7, by so placing spacers 42 and resting them on the top of the central portion of the pizza shell the shells may be stacked as shown with said spacers 42 spacing the packages apart for ventilation to assist in cooling the baked pizza shells.

By making the depth of spacer 42 greater than the depth of the package, the packages are vertically spaced apart when stacked thus improving air circulation.

It will be seen from FIG. 1 that by providing six equally spaced cut lines 30 instead of the four illustrated four sections may be provided instead of the three above described. In such a case the configuration of FIG. 8 may be provided forming a quadrangular prism shape at the center. It will also be apparent that five or more sections may be formed in a similar manner.

Instead of stacking the filled packages it may be desirable in some instances to display them by hanging them on a rod or similar support. To this end the blank 10 may be formed with an apertured tab 48 to permit the package to be suspended from such support.

As best seen in FIG. 2 the specific embodiment described above is a package whose depth increases toward the center. However, if desired the tops and bottoms of the sections may be parallel if desired or may slope downwardly toward the center (FIG. 7).

It will also be apparent that the package is adapted for use with a ring shaped article or several smaller articles.

Another feature of the above described structure is that a small prismatic package may be housed within the central opening at the point of purchase. Such a package may contain a sauce or other ingredients which may be employed when the user completes the pizza by adding the usual edibles to the pizza shell.

I claim:

1. A package for an article comprising a plurality of rectangular shaped sections, each of said sections including a top, a bottom, an outer side wall and an inner side wall, each of said inner side walls being secured together to form a central prismatic space with said sections extending radially outwardly therefrom.

2. A package according to claim 1 wherein each of said inner sidewalls comprises separate upper and lower portions for receiving an article therebetween.

3. A package according to claim 1 wherein said inner sidewalls define the sidewalls of a triangular prism.

4. A package according to claim 1 wherein said inner sidewalls define the sidewalls of a quadrangular prism.

5. A package according to claim 1 wherein said entire package is formed from a unitary blank of sheet material.

6. A package according to claim 1 wherein a prism shaped spacer is received in said space to permit stacking a plurality of packages.

7. A package according to claim 2 wherein a tray for supporting such article is interposed between said portions, said tray being formed with a downwardly projecting well complementarily formed to said prismatic space.

8. A package according to claim 5 wherein said blank is formed with an apertured tab for suspending said package.

9. A package for an article comprising:

a generally rectangular planar blank, said blank including a central rectangular section extending between opposite ends thereof, said blank including rectangular marginal portions adjacent and parallel to its side edges, cut lines extending from said side edges to said central section to provide a plurality of panels on opposite sides of said central section, whereby said panels may be swung about the opposite sides of said central section with the portions adjacent said central section in superposed spaced apart relationship and with said marginal portions in coplanar relationship, and whereby pairs of said superposed portions may be swung about fold lines extending transversely of said central section to circumferentially spaced apart relation and defining a central prismatic space.

10. A package according to claim 9 wherein said blank is formed with an apertured tab for suspending the package.

11. A package according to claim 9 wherein said blank includes extensions for securing said marginal portions together.

* * * * *